United States Patent [19]

Sheng-Wei

[11] 4,285,456

[45] Aug. 25, 1981

[54] CONSECUTIVELY NAILING MACHINE

[76] Inventor: Wu Sheng-Wei, No. 33, Tieh Shieh Chun, Fang Liao Hsiang, Pingtung Hsien, Taiwan

[21] Appl. No.: 24,521

[22] Filed: Mar. 28, 1979

[51] Int. Cl.[3] ..... B25C 1/02

[52] U.S. Cl. ..... 227/147; 227/120; 227/119; 206/338

[58] Field of Search ..... 227/109, 119, 120, 147, 227/148; 206/338

[56] References Cited

U.S. PATENT DOCUMENTS

| | | | |
|---|---|---|---|
| 333,159 | 12/1885 | Richards | 206/338 |
| 2,994,878 | 8/1961 | Abrahamsen | 227/147 X |
| 4,096,982 | 6/1978 | Stahl | 227/120 X |

*Primary Examiner*—Paul A. Bell

*Attorney, Agent, or Firm*—Blair, Brown & Kreten

[57] ABSTRACT

Disclosed herein is a consecutive nailing machine with specially joined nails manufactured in rows. The machine is capable of hammering the joined nails one by one, separatively and consecutively, into wood.

5 Claims, 14 Drawing Figures

CONSECUTIVELY NAILING MACHINE

BACKGROUND OF THE INVENTION

The usual method for driving a nail is to hold it in position with one hand hit its head with a hammer held in the other hand until it is started; then the nail is continuously struck with the hammer until it sinks into the wood. Such a method for driving nails has the following disadvantages:

1. Low efficiency: In the traditional nailing process, one has to first locate then position each consecutive nail used; therefore, the work is interrupted and the working procedure is increased, decreasing efficiency.
2. Low safety: In the traditional nailing process, one has to hold a nail in position with one hand and hammer its head with the other hand. Fingers will be harmed if insufficient attention is paid to the work.

SUMMARY OF THE INVENTION

The invention provides a highly efficient consecutive nailing machine which is characterized by the use of joined nails in a row structure similar to staples. Hitting a hammer on the thrust pin on the top of the nailing machine, which contains the joined nails, will drive the nails into wood one by one.

Holding nails in position by hand is no longer necessary when using said nailing machine, and thus the hammer will not harm one's fingers and safety is increased. The joined nails contained in the magazine are pushed forward after each nailing; therefore, searching for another nail is unnecessary and work efficiency is improved.

DESCRIPTION OF THE PREFERRED EMBODIMENT

Figure 1:
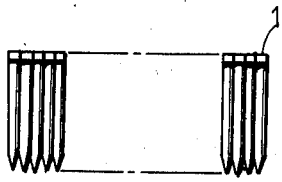
FIG. 1: Joined nails in a linear row structure.
Figure 2:
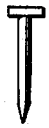
FIG. 2: A side view of FIG. 1.
Figure 3:
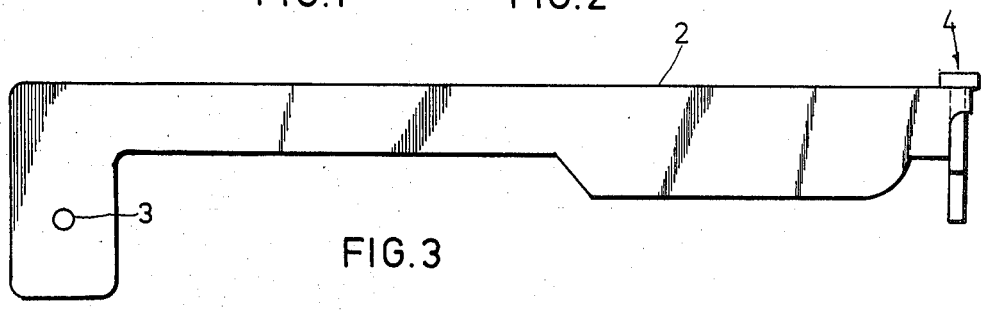
FIG. 3: Thrust pin on top of the nailing machine.
Figures 4, 5, 6:
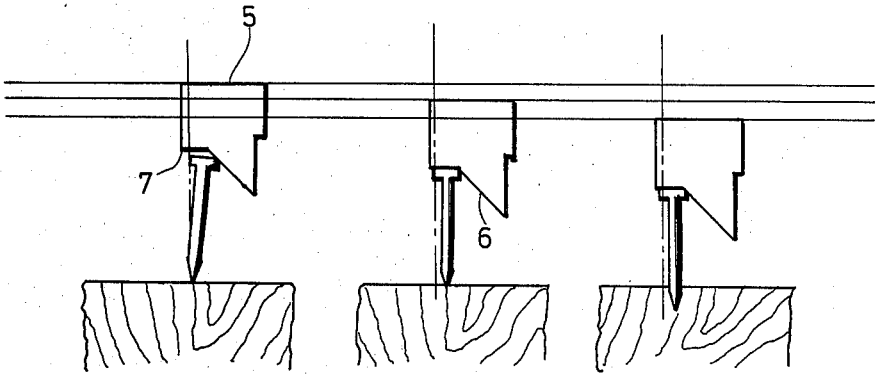
FIG. 4: A view illustrating thrust pin contacting the nail head prior to hitting of nail.
FIG. 5: Thrust pin is hit and then guides nail into position.
FIG. 6: Thrust surface of thrust pin driving nail into wood.
Figure 7:
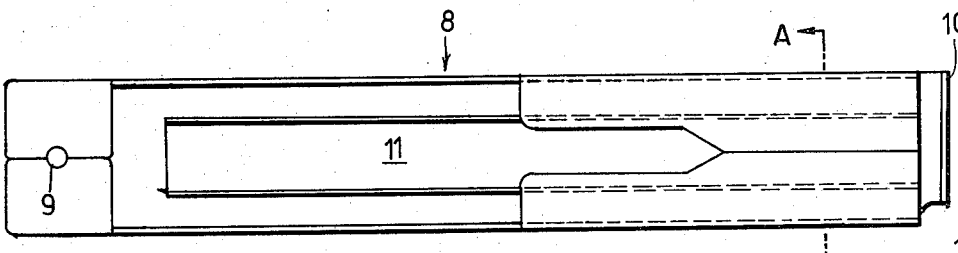
FIG. 7: A side view of the consecutively nailing machine.

The substantial components of this invention are as follows: FIG. 1 shows a row of joined nails 1 with square heads and FIG. 2 is the side view thereof. FIG. 3 shows an upper cover 2 which is in the shape of a reversed "L". At its tail there is a pin hole 3 and at its front extremity there is a thrust pin 4. As indicated in FIG. 4, a thrust pin has a pin head 5, a guidance surface 6 and a nailing surface 7. FIG. 7 shows a machine body

Figure 8:
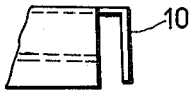
FIG. 8: A top view of nail hook.
Figure 9:
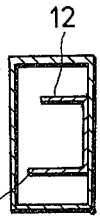
FIG. 9: Sectional view of Line A—A of the nailing machine body.
Figure 10:
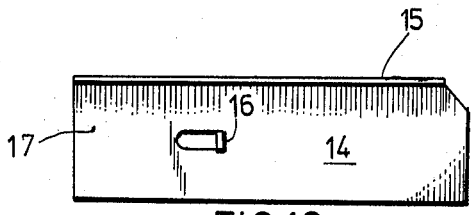
FIG. 10: A side view of the thrust board.
Figure 11:
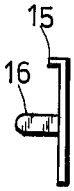
FIG. 11: An end view of the thrust board, i.e., side view of FIG. 10.

8 which is a rectangular box made of metal plate. At the tail of said body there is a pin hole 9 and at its medial section there is an opening for loading the joined nail rows 1. The turning section at the front of the machine body 8 is called the nail hook 10. FIG. 8 is a top view of said nail hook. Between said nail hook 10 and the machine body 8 there is a gap which is slightly wider than a nail so that a nail can slide through the gap and be driven into wood. Within the machine body 8 there is a guide plate 11 which is in the shape of "M". As shown in FIG. 9, the upper guide plate 12 is slightly shorter than the lower guide plate 13. FIG. 10 shows a thrust board 14 which has a turning part 15 at its outward top end. On the middle of said thrust board 14 there is a bulge 16 which is aligned in the same direction as said turning part in order to ease pushing of the thrust board with one's fingers. At the tail of the thrust board 14 there is a spring fixing hole 17 so that the spring 18 can be firmly held by the fixing hole 17.

Figure 13:
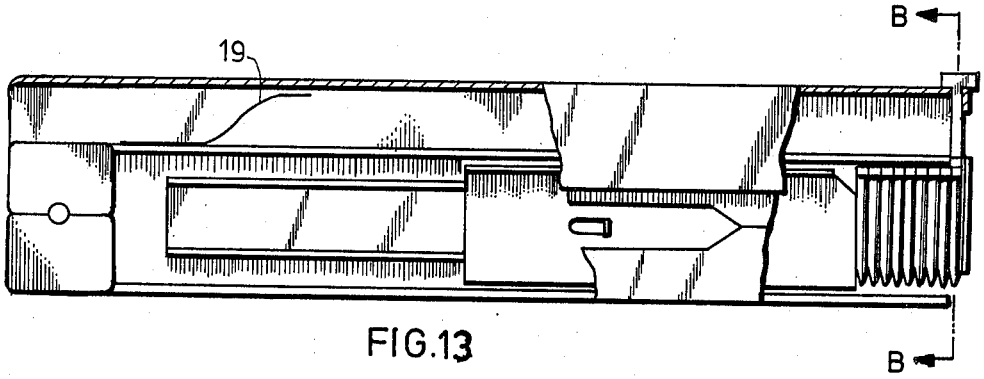
FIG. 13: Joined nail rows in a machine body.
Figure 14:
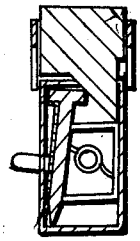
FIG. 14: A view of FIG. 13 along lines B—B.
Figure 12:
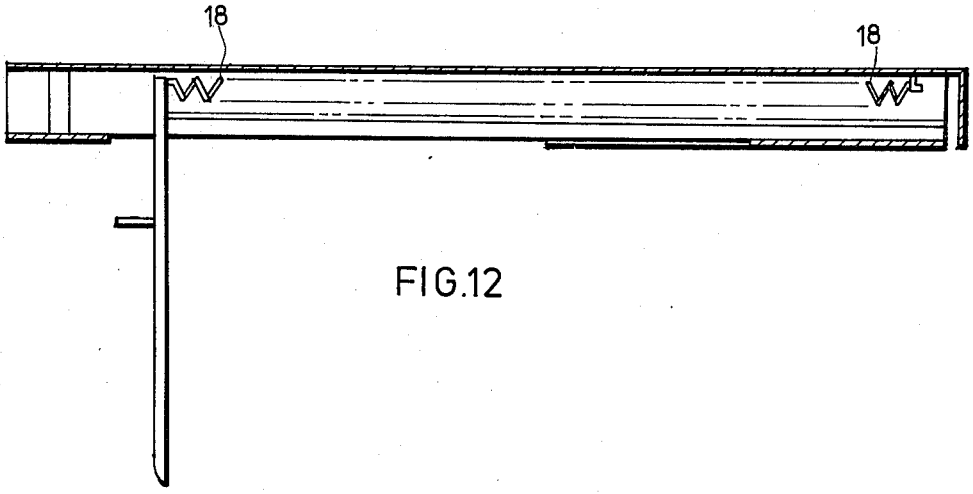
FIG. 12: Top view after opening of thrust board.

The thrust board 14 is easily loaded into said machine body 8 through the opening on the body. One end of the spring 18 is fixed to the fixing hole 17 of the thrust board 14 and the other end is fixed to the machine body 8 so that thrust board 14 will always exert pressure towards the front of the machine body 8 by the compression force of the spring. In order to load the joined nails 1 into the body, the thrust board must be pushed backward towards the end of the guide plate 12, and then opened outwardly. FIG. 12 is a top view after the thrust board 14 is opened. The spring 18 is extended and the row of joined nails 1 can be loaded into the machine body 8 through the opening in the body. FIG. 13 shows a row of joined nails 1 in the body 8. The thrust board 14 contantly pushes the row of joined nails forward towards the front of the body because of the compression force of the spring. The row of joined nails 1 is stopped by the nail hook 10. Since the gap between the nail hook 10 and body 8 can hold only one nail at a time, just one nail is exposed from the body 8. The nail which is exposed has its head facing the thrust pin 4. FIG. 14 is a side view of FIG. 13, in which the row of joined nails 1 is within the body 8. Since the upper guide plate 12 is shorter than the lower guide plate 13, the row of joined nails is disposed in an inclined position. The head of the exposed nail contacts the guidance surface 6 of the thrust pin 4 at one point only. When the thrust pin 4 is hit, the pin will hit the nail and drive the nail into wood. FIG. 4, FIG. 5 and FIG. 6 are a series of drawings indicating the consecutive action of the thrust pin 4 hitting a nail. FIG. 4 shows the guidance surface 6 in contact with a nail head at a point just prior to hitting of the thrust pin 4. FIG. 5 shows the guidance surface 6 of the thrust pin holding a nail in position while the thrust pin is hit. At that moment, the nail is separated from the row and the nail head fully contacts the nailing surface 7 of the thrust pin 4. FIG. 6 shows how the nailing surface 7 of the thrust pin drives a nail into wood. Since the nailing surface 7 contacts the whole surface of the nail head, the nail is vertically driven into the wood. After nailing into the wood, a spring 19 in the body supported by the upper cover returns the thrust pin 4 to its original position. Then, the row of joined nails 1 is pushed forward and another nail is positioned in the gap between the nail hook 10 and the machine body 8 in preparation for the next nailing.

In operation the structural features mentioned above work as follows: As shown in FIG. 13, which a front view of the assembly disclosed herein, the upper cover 2 and the machine body 8 are connected together through the connecting pin holes 3 and 9. There is a spring 19 between the upper cover 2 and the machine body 8. In operation the thrust board 14 must be pushed backward to the end of the guidance plate 12, and then oped outwardly as shown in FIG. 12. Then, a row of joined nails 1 can be loaded through the opening in said machine body 8. The thrust board 14 is also loaded through the opening. Because of the compression force of the spring 18 on the thrust board 14, the thrust board is forced towards the front of the machine body 8 and is stopped by the nail hook 10. At that point, there is a nail exposed in the gap between the machine body 8 and the nail hook 10. The exposed nail has its head facing the thrust pin 4 at the upper cover 2. With a light pressure, the thrust pin is hit, then, as in the action illustrated by FIGS. 4–6, a nail is driven into the working piece. After moving the machine, the nailing procedure is repeated.

I claim:

1. A nailing machine comprising an area for storing an interconnected row of nails within said machine at an angle so that a head and body portion of a nail is canted relative to a vertical plane, and a thrust pin for driving individual nails into material to be fastened including an inclined guidance surface relative to a vertical plane for coacting against a single nail disposed at a terminal portion of a row whereby coaction of said guidance surface with said nail dissociates said nail from said row by vertically orienting said nail so that said thrust pin can drive said nail into the material to be fastened wherein said area for storing said row of nails includes a substantially box shaped container having one side wall with an inwardly directed guide plate including a pair of legs: a shorter horizontal upper leg and a longer parallel lower leg whereby said row of nails are canted thereagainst.

2. The device of claim 1 wherein said area for storing said row of nails is spring biased to advance nails consecutively to said thrust pin.

3. The device of claim 1 wherein said thrust pin is supported on an inverted "L" shaped upper cover pivoted to said storage area remote from the thrust pin area.

4. The device of claim 2 wherein a nail hook is provided at the thrust pin area of the nailing machine to expose only a single nail for deployment, said nail hook acting against said biasing spring.

5. The device of claim 4 wherein a thrust board is provided in said storage area on a side of the nails opposite said legs, said spring bias connected thereto to urge said nails to the thrust pin area.

* * * * *